US006796879B2

(12) United States Patent
Cheng et al.

(10) Patent No.: US 6,796,879 B2
(45) Date of Patent: Sep. 28, 2004

(54) DUAL WAFER-LOSS SENSOR AND WATER-RESISTANT SENSOR HOLDER

(75) Inventors: Rico Cheng, Kaohsiung (TW); Kang-Yung Peng, Hsin-Chu (TW); Kevin Lai, Taichung (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 178 days.

(21) Appl. No.: 10/045,781

(22) Filed: Jan. 12, 2002

(65) Prior Publication Data

US 2003/0134571 A1 Jul. 17, 2003

(51) Int. Cl.[7] ..... B24B 49/00

(52) U.S. Cl. ..... 451/6; 451/8; 451/10; 451/41; 451/285; 269/21; 269/903

(58) Field of Search ..... 451/6, 8, 21, 285–290, 451/443, 10, 444, 165; 269/21, 903

(56) References Cited

U.S. PATENT DOCUMENTS

| | | | | | |
|---|---|---|---|---|---|
| 6,045,434 | A | * | 4/2000 | Fisher et al. | 451/6 |
| 6,159,073 | A | * | 12/2000 | Wiswesser et al. | 451/6 |
| 6,261,152 | B1 | * | 7/2001 | Aiyer | 451/6 |
| 6,264,532 | B1 | * | 7/2001 | Meloni | 451/6 |
| 6,609,947 | B1 | * | 8/2003 | Moore | 451/5 |

* cited by examiner

*Primary Examiner*—Joseph J. Hail, III
*Assistant Examiner*—Anthony Ojini
(74) *Attorney, Agent, or Firm*—Tung & Associates

(57) ABSTRACT

A dual semiconductor wafer slippage, or loss, and water-resistant sensor holder for chemical mechanical polishing (CMP) semiconductor fabrication equipment is disclosed. The holder has a body and a cover. The body is designed to hold two wafer slippage sensors at an angle to a vertical plane, such as substantially fifteen degrees, and has a window to allow the sensors to detect wafer slippage. The cover is situated over the window of the body to prevent slurry from spraying and drying onto the sensors during high-pressure rinse cleaning of a platen of the CMP semiconductor fabrication equipment.

15 Claims, 8 Drawing Sheets

DUAL WAFER-LOSS SENSOR AND WATER-RESISTANT SENSOR HOLDER

FIELD OF THE INVENTION

This invention relates generally to semiconductor fabrication equipment for the fabrication process of chemical mechanical polishing (CMP), and more particularly to wafer-loss sensors and their holders for such equipment.

BACKGROUND OF THE INVENTION

Chemical mechanical polishing (CMP) is a semiconductor wafer flattening and polishing process that combines chemical removal with mechanical buffing. It is used for polishing and flattening wafers after crystal growing, and for wafer planarization during the wafer fabrication process. CMP is a favored process because it can achieve global planarization across the entire wafer surface, can polish and remove all materials from the wafer, can work on multi-material surfaces, avoids the use of hazardous gasses, and is usually a low-cost process.

FIGS. 1A and 1B show an example effect of performing CMP. In FIG. 1A, a semiconductor wafer 102 has a patterned dielectric layer 104, over which a metal layer 106 has been deposited. The metal layer 106 has a rough top surface, and there is more metal than necessary. Therefore, CMP is performed, resulting in FIG. 1B. In FIG. 1B, the metal layer 106 has been polished down so that it only fills the gaps within the dielectric layer 104.

FIG. 2 shows an example CMP system 200 for polishing the wafer 102 of FIGS. 1A and 1B. The wafer 102, with its dielectric layer 104 and metal layer 106, is placed on a platen 202 connected to a rotatable rod 206. A polishing pad 204 is lowered over the wafer 102, specifically over the metal layer 106 thereof. The polishing pad 204 is also connected to a rotatable rod 206. Slurry 210 is introduced between the polishing pad 204 and the metal layer 106, and the polishing pad 204 is lowered, pressured against the metal layer 106, and rotated to polish away the excess, undesired metal from the metal layer 106. The platen 202 is rotated as in the opposite direction. The combined actions of the two rotations and the abrasive slurry 210 polish the wafer surface.

The polishing pad 204 can be made of cast polyurethane foam with fillers, polyurethane impregnated felts, or other materials with desired properties. Important pad properties include porosity, compressibility, and hardness. Porosity, usually measured as the specific gravity of the material, governs the pad's ability to deliver slurry in its pores and remove material with the pore walls. Compressibility and hardness relate to the pad's ability to conform to the initial surface irregularities. Generally, the harder the pad is, the more global the planarization is. Softer pads tend to contact both the high and low spots, causing non-planar polishing. Another approach is to use flexible polish heads that allow more conformity to the initial wafer surface.

The slurry 210 has a chemistry that is complex, due to its dual role. On the mechanical side, the slurry is carrying abrasives. Small pieces of silica are used for oxide polishing. Alumina is a standard for metals. Abrasive diameters are usually kept to 10–300 nanometers (nm) in size, to achieve polishing, as opposed to grinding, which uses larger diameter abrasives but causes more surface damage. On the chemical side, the etchant may be potassium hydroxide or ammonium hydroxide, for silicon or silicon dioxide, respectively. For metals such as copper, reactions usually start with an oxidation of the metal from the water in the slurry. Various additives may be found in slurries, to balance their ph, to establish wanted flow characteristics, and for other reasons.

One difficulty with CMP semiconductor fabrication equipment is that the semiconductor wafer may slip from the platen during rotation. The platen rotates at a fast speed, such that wafer slippage can be a common occurrence. If the wafer slips out from under the polishing pad and is not detected, the wafer may be flung out by the rotating platen and break. More seriously, if the slipped wafer is not detected, the small pieces into which the wafer breaks may affect semiconductor wafers on neighboring platens, also damaging them. If the polishing pad continues to rotate where the wafer has slipped out from under the pad, the membrane of the polishing pad mechanism can also break. All of these problems are costly.

To avoid this problem, sensors have been developed to detect wafer slippage, or wafer loss. Generally, the wafer is darker in color than the platen and pad, so that if the wafer has slipped from the platen, the change in brightness, or color, can be detected to determine whether wafer loss or slippage has occurred. A single sensor in such cases typically can detect wafer loss. However, some platens and pads are similar in color or brightness to the wafer, rendering the distinction process for determining wafer slippage or loss more difficult to perform. In these cases, conversely, a double sensor has been developed to detect wafer loss. However, it has been determined that the double sensor as currently developed is not properly detecting wafer slippage where the platen and/or pad is similar in color or brightness to the wafer.

FIG. 3 shows a conventional single sensor system 300, including a single optical wafer loss sensor 304 held at an angle to vertical within a sensor holder 302. A wafer 308 is on a pad of a platen 306. Because the platen 306 is lighter in color than the wafer 308, the sensor 304 can optically detect when the wafer 308 has slipped from the platen 306. This is accomplished by emitting light 310 that is reflected back as the light 312. More light will be reflected back from one of the platen 306 and the wafer 308, depending on their color characteristics, their reflectivity variations, and so on. The sensor 304 can thus be calibrated to properly detect when the wafer 308 has slipped. However, this convention single sensor system 300 does not adequately determine wafer slippage where the pad of the platen 306 has a substantially similar color, brightness, reflectivity, or other attribute to that of the wafer 308, without generating a significant number of false detections.

FIG. 4 shows a proposed conventional dual sensor system 400, including dual optical wafer loss sensors 404 and 405 held vertically at no angle within a sensor holder 402. The wafer 308 is on a pad of a platen 406 that is the same color, or otherwise has a substantially similar attribute, as that of the wafer 308. In theory, emitting light 410 from the sensor 404 and/or emitting light 411 from the sensor 405 will cause some reflection back as the light 412 and the light 413, respectively, where different amounts or qualities of the light reflected back can indicate whether the light bounced off the platen 406, indicating wafer slippage, or from the wafer 308, indicating no wafer slippage. However, this proposed conventional dual sensor system 400 has been found to not adequately determine wafer slippage where the pad of the platen 406 has a substantially similar color, brightness, reflectivity, or other attribute to that of the wafer 308, even though this is its designed-for purpose.

Another difficulty with CMP semiconductor fabrication equipment is that the slurry may spray up onto the wafer slippage or loss sensor(s) when the pad or the platen is being rinsed of excess slurry. The slurry then dries on the sensor, and as a white solid, causing false wafer slippage detection by the obfuscated sensor. This situation is shown in FIG. 5. A conventional sensor system 500 includes a platen 502, a sensor holder 504, and a sensor 506. To clean the platen 502, a high-pressure rinse action is performed while the platen 502 rotates. As a result of the high-pressure rinse action, as indicated by the arrow 508, slurry can be sprayed onto the sensor 506, and later dry as the dry slurry 510. This dry slurry 510 obfuscates the sensor 506, and causes false wafer slippage or loss alarms to be generated.

Therefore, there is a need for CMP that overcomes the disadvantages of conventional CMP as found in the prior art. Specifically, there is a need for detecting wafer slippage or loss, even where the pad and/or the platen have a color or other attribute substantially similar to the wafer, without a significant number of false detections. There is also a need for preventing slurry from spraying and drying onto wafer slippage or loss sensors while the platen is being high-pressure rinsed. For these and other reasons, there is a need for the present invention.

SUMMARY OF THE INVENTION

The invention relates to a dual semiconductor wafer slippage, or loss, and water-resistant sensor holder for chemical mechanical polishing (CMP) semiconductor fabrication equipment. The holder has a body and a cover. The body is designed to hold two wafer slippage sensors at an angle to a vertical plane, such as substantially fifteen degrees, and has a window to allow the sensors to detect wafer slippage. The cover is situated over the window of the body to prevent slurry from spraying and drying onto the sensors during high-pressure rinse cleaning of a platen of the CMP semiconductor fabrication equipment.

Embodiments of the invention provide for advantages over the prior art. The dual sensors as held by a dual-sensor holder of the invention have been found to be able to detect semiconductor wafer slippage and loss, even where the semiconductor wafer has a substantially identical quality, such as color, and so on, to that of the platen or the platen pad. Preferably, a horizontally opposite configuration of the dual sensors, combined with their positioning at an angle to a vertical plane, allow for such detection. Furthermore, the slippage and loss detection is accomplished without a significant number of false detections being made by the sensors. The cover of the dual-sensor holder of the invention additionally prevents slurry from affecting the sensors' ability to detect wafer slippage and loss.

Other advantages, embodiments, and aspects of the invention will become apparent by reading the detailed description that follows, and by referencing the attached drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1A:
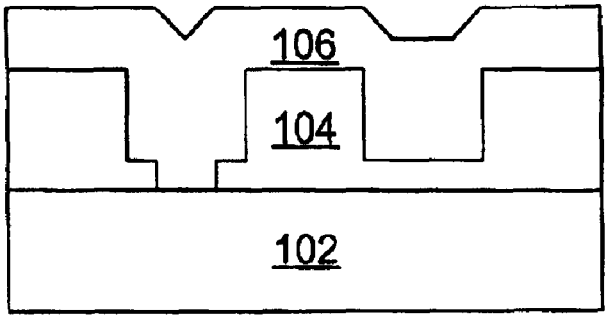
FIGS. 1A and 1B are diagrams showing an example chemical mechanical polishing (CMP) semiconductor fabrication operation.
Figure 1B:
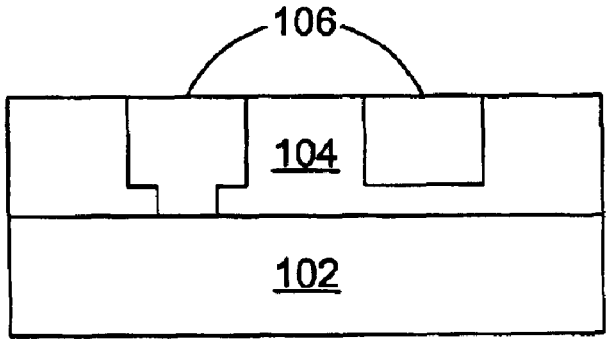
Figure 2:
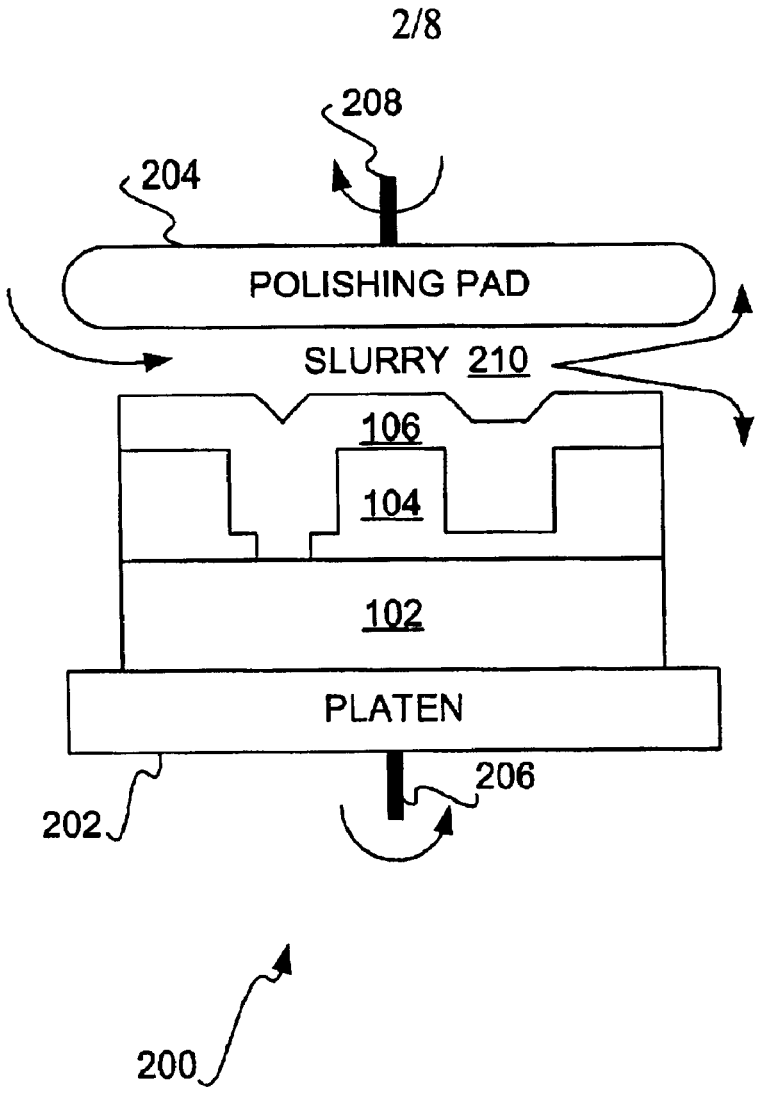
FIG. 2 is a diagram of an example CMP semiconductor fabrication system, in conjunction with which embodiments of the invention can be implemented.
Figure 3:
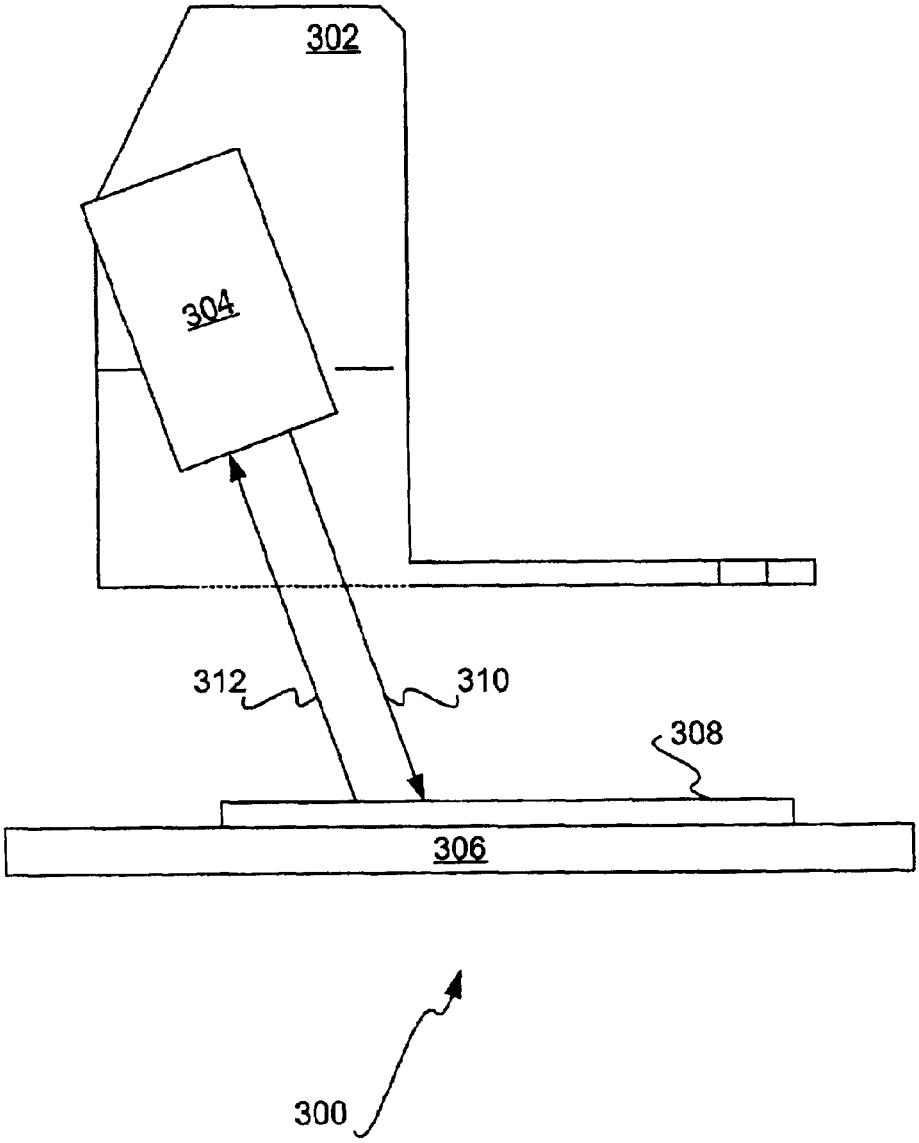
PRIOR ART FIG 3
FIG. 3 is a diagram of a conventional single-sensor wafer slippage or loss detection CMP system that is not able to detect wafer slippage where the wafer has a substantially identical color to a platen of the system, without a significant number of false detections.
Figure 4:
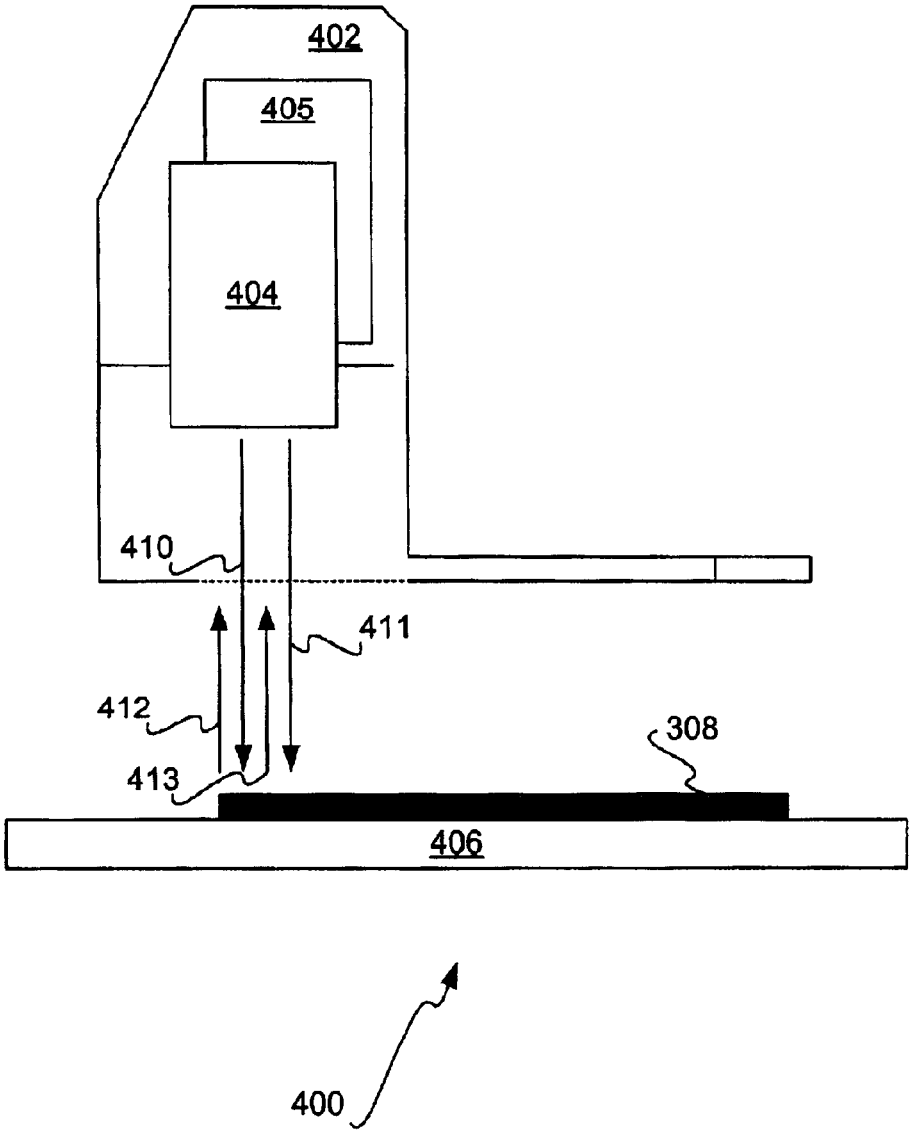
PRIOR ART FIG 4
FIG. 4 is a diagram of a conventional dual-sensor wafer slippage or loss detection CMP system that is designed to detect wafer slippage where the wafer has a substantially identical color to a platen of the system, but which does successfully detect such slippage.
Figure 5:
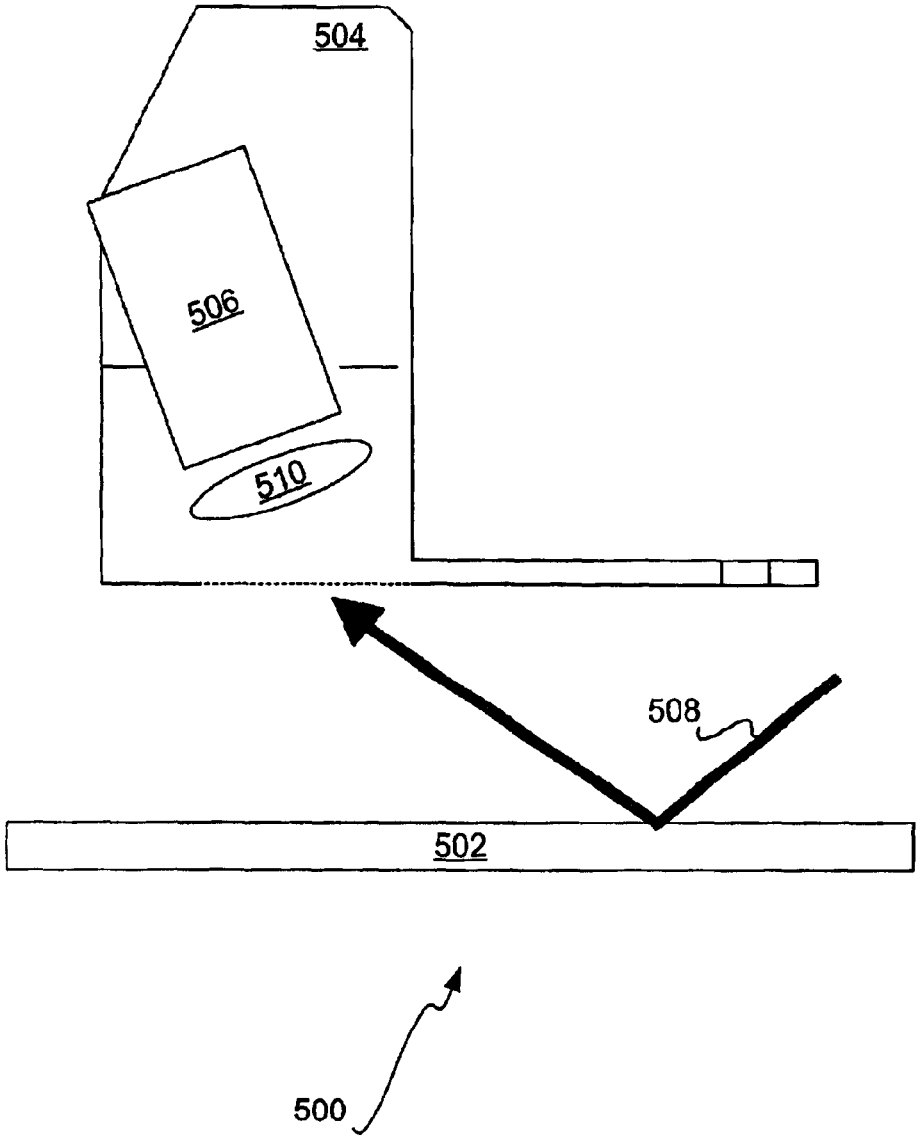
PRIOR ART FIG 5
FIG. 5 is a diagram of a conventional wafer slippage or loss detection CMP system showing how slurry can spray and dry onto a sensor of the system when a platen of the system is being high-pressure rinsed.
Figure 6A:
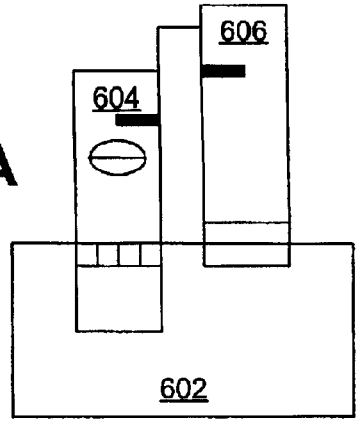
FIGS. 6A, 6B, and 6C are diagrams of a dual wafer-loss sensor holder according to an embodiment of the invention.
Figure 6B:
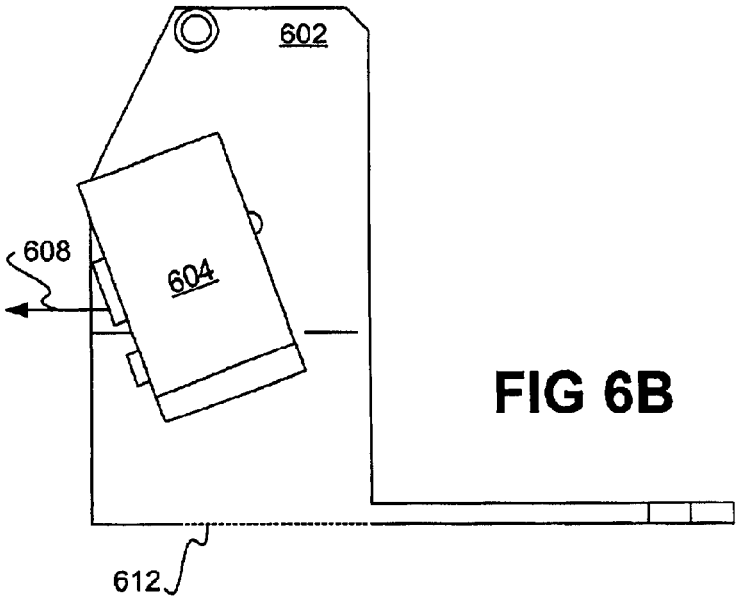
Figure 6C:
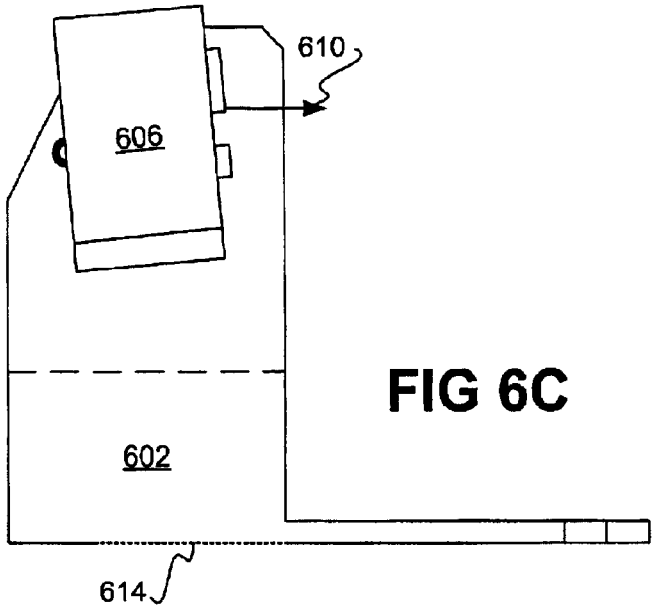

FIGS. 6A, 6B, and 6C show a dual wafer-loss sensor holder 602 according to an embodiment of the invention. The holder 602 can be used in conjunction with chemical mechanical polishing (CMP) semiconductor fabrication equipment, such as that shown in FIG. 2 and previously described. In one embodiment, the CMP semiconductor fabrication equipment is that available from Applied Materials Taiwan (AMT), of Taiwan. However, the invention can also be applied to other types of CMP semiconductor fabrication equipment. FIG. 6A shows a front view of the holder 602, whereas FIGS. 6B and 6C show differing cross-sectional side views of the holder 602.

The holder 602 is designed to hold a first wafer-loss or slip sensor 604, and a second wafer-loss or slip sensor 606. The first sensor 604 is preferably for detecting wafer slippage where the wafer has an attribute different than that of the platen or platen pad of the CMP equipment. This attribute may be color, reflectivity, brightness, or another attribute. By comparison, the second sensor 606 is preferably for detecting wafer slippage where the wafer has an attribute substantially identical to that of the platen or platen pad of the CMP equipment. Each of the sensors 604 and 606 can be an optical sensor in one embodiment.

As shown in FIGS. 6B and 6C specifically, each of the sensors 604 and 606 is situated within a cavity of the holder 602 such that they are at an angle to an imaginary vertical plane running through the holder 602. Preferably, this angle is substantially fifteen degrees. Moreover, the sensors 604 and 606 are horizontally configured in an opposite manner to each other. For example, the sensor 604 has its front towards the left, as indicated by the arrow 608 in FIG. 6B, whereas the sensor 606 has its front towards the right, as indicated by the arrow 610 in FIG. 6C. There is an opening in the holder 602 to expose each of the sensors 604 and 606 as well. The opening 612 in FIG. 6B is to expose the sensor 604, whereas the opening 614 in FIG. 6C is to expose the sensor 606. The openings 612 and 614 enable their corresponding sensors to optically detect wafer slippage or loss from the platen of the CMP equipment.

Figure 7:
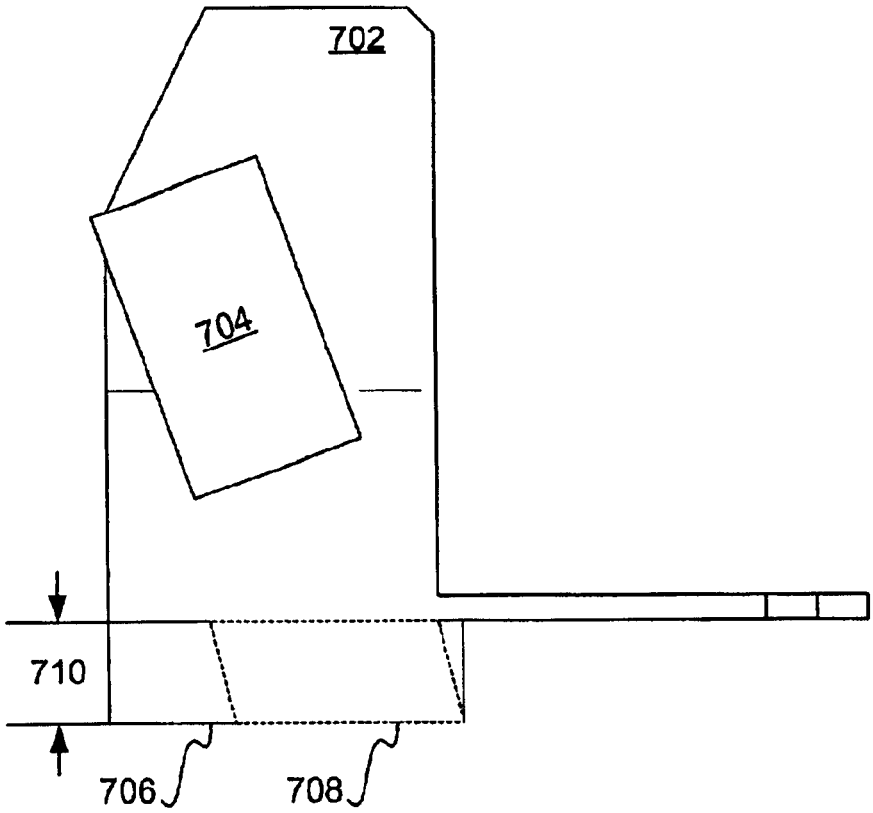
FIG. 7 is a diagram of a dual wafer-loss sensor holder having a cover to prevent slurry from spraying and drying on the dual wafer-loss sensor, according to an embodiment of the invention.

FIG. 7 shows a wafer-loss sensor holder 702 according to another embodiment of the invention. The holder 702 can be implemented in conjunction with the holder 602 of FIGS. 6A, 6B, and 6C. The holder 702 may also be used in conjunction with CMP equipment such as that which has been described in conjunction with FIG. 2. The holder 702 also has a cavity to hold a sensor 704, and may also have a cavity to hold another sensor. The holder 702 has extending from its bottom side a cover 706. The cover 706 prevents slurry from spraying and drying on the sensor 704 during high-pressure rinse cleaning of the platen and other components of the CMP equipment. The cover 706 still has an opening 708 so that the optics of the sensor 704 can detect wafer loss or slippage, where the sensor 704 is optical in nature. Preferably, the cover 706 has a height 710 that extends one centimeter (cm) below the bottom of the holder 702.

Figure 8:
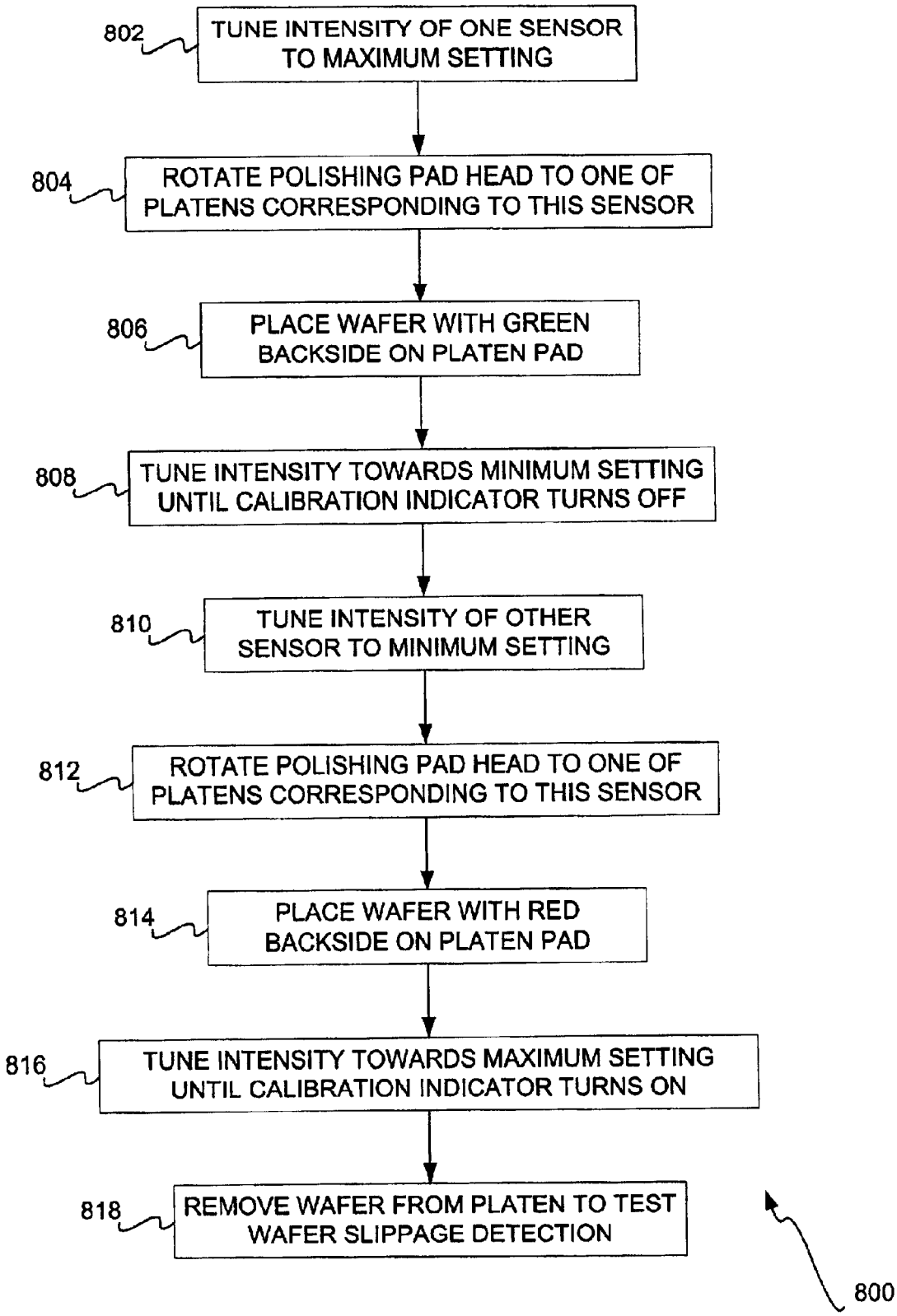
FIG. 8 is a flowchart of a method to initialize a CMP system having a dual wafer-loss sensor holder, according to an embodiment of the invention.

FIG. 8 shows a method 800 according to which one embodiment initializes or otherwise calibrates a dual-wafer loss or wafer slippage sensor within a holder according to an embodiment of the invention. The method 800 is preferably performed in conjunction with CMP equipment available from AMT. 802, 804, 806, and 808 are performed to calibrate one of the sensors, such as the sensor 604 of FIGS. 6A, 6B, and 6C, and 810, 812, 814, and 816 are performed to calibrate the other sensor, such as the sensor 606 of FIGS. 6A, 6B, and 6C. 818 can be performed relative to either sensor.

First, the intensity of one of the sensors is set to its maximum setting (802). This is specifically the sensor that is used to detect wafer slippage or loss where the wafer has an attribute different than that of the underlying platen or platen pad. The polishing pad, typically mounted on what is referred to as a head, is rotated or otherwise positioned to one of these platens, such that it is over the platen (804). For example, there may be two such platens in a given CMP equipment. A test wafer with a green backside is placed on this platen or platen pad (806), and the intensity of the sensor is decreased or tuned towards its minimum setting until a wafer slippage calibration indicator turns off (808). This can be a red indicator light, for example. At this point, this sensor has been calibrated.

Next, the intensity of the other sensor is tuned to its minimum setting (810). This is specifically the sensor that is used to detect wafer slippage or loss where the wafer has an attribute at least substantially identical to that of the underlying platen or platen pad. The polishing pad head is rotated or otherwise positioned over this platen (812). For example, there may be only one such platen in a given CMP equipment. A test wafer with a red backside is placed on this platen or platen pad (814), and the intensity of the sensor is increased or tuned towards its maximum setting until a wafer slippage calibration indicator turns on (816). This can be a red indicator light, for example. At this point, this sensor has also been calibrated.

To test the detecting function, the red-backsided wafer is removed from the platen (818), such that the sensor just calibrated should detect slippage or loss, as can be indicated by a green light indicator. Furthermore, the polishing pad head can be rotated over one of the other platens, such that the sensor initially calibrated should detect slippage or loss, as can also be indicated by a green light indicator. The method 800 is thus completed.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

What is claimed is:

1. A dual-semiconductor wafer slippage sensor holder for chemical mechanical polishing (CMP) semiconductor fabrication equipment comprising:

a body designed to hold two wafer slippage sensors at an angle to a vertical plane, the body having a window to allow the sensors to detect wafer slippage; and a cover situated over the window of the body to prevent slurry from spraying and drying onto the sensors during high-pressure rinse cleaning of a platen of the CMP semiconductor fabrication equipment, wherein the sensors held in the body are able to detect wafer slippage where a semiconductor wafer and a platen from which the semiconductor wafer can slip both have a substantially identical attribute.

2. The holder of claim 1, wherein the body is designed to hold the two wafer slippage sensors in a horizontally opposite configuration from one another.

3. The holder of claim 1, wherein the substantially identical attribute is color.

4. The holder of claim 1, wherein the substantially identical attribute is reflectivity.

5. The holder of claim 1, wherein the substantially identical attribute is brightness.

6. The holder of claim 1, wherein the angle to the vertical plane is substantially fifteen degrees.

7. The holder of claim 1, wherein the cover extends substantially one centimeter from the body.

8. A chemical mechanical polishing (CMP) semiconductor fabrication system comprising:

a rotatable polishing pad for polishing a semiconductor wafer using slurry;

an oppositely rotatable platen underneath the polishing pad on which the semiconductor wafer is positioned for polishing by the polishing pad;

dual sensors for detecting semiconductor wafer slippage of the semiconductor wafer from the platen; and a holder to hold the dual sensors at an angle to a vertical plane, the holder having a window exposing the sensors, wherein the platen has an attribute substantially identical to an attribute of the semiconductor wafer.

9. The system of claim 8, wherein the holder comprises a cover situated over the window to prevent the slurry from spraying and drying onto the dual sensors during high-pressure rinse cleaning of the platen.

10. The system of claim 9, wherein the cover extends substantially one centimeter from the holder.

11. The system of claim 8, wherein the dual sensors are situated in horizontally opposite configurations.

12. The system of claim 8, wherein the attribute is color.

13. The system of claim 8, wherein the attribute is reflectivity.

14. The system of claim 8, wherein the attribute is brightness.

15. The system of claim 8, wherein the angle to the vertical plane is substantially fifteen degrees.

* * * * *